US009044991B2

(12) United States Patent
Rubin

(10) Patent No.: US 9,044,991 B2
(45) Date of Patent: Jun. 2, 2015

(54) APPARATUS AND METHOD FOR A GREETING BAG

(71) Applicant: Richard H. Rubin, Melville, NY (US)

(72) Inventor: Richard H. Rubin, Melville, NY (US)

( * ) Notice: Subject to any disclaimer, the term of this patent is extended or adjusted under 35 U.S.C. 154(b) by 0 days.

(21) Appl. No.: 13/910,013

(22) Filed: Jun. 4, 2013

(65) Prior Publication Data

US 2013/0283654 A1 Oct. 31, 2013

Related U.S. Application Data

(63) Continuation of application No. 12/229,133, filed on Aug. 20, 2008, now Pat. No. 8,474,163.

(60) Provisional application No. 60/965,674, filed on Aug. 21, 2007.

(51) Int. Cl.

| | |
|---|---|
| ***G09F 1/00*** | (2006.01) |
| ***B42D 15/04*** | (2006.01) |
| ***B65D 33/00*** | (2006.01) |

(52) U.S. Cl.

CPC ..... *B42D 15/042* (2013.01); *B42D 15/045* (2013.01); *B65D 33/004* (2013.01)

(58) Field of Classification Search

USPC ..... 40/124.06, 124.11; 383/40; 206/457, 206/232; 428/542.2

See application file for complete search history.

(56) References Cited

U.S. PATENT DOCUMENTS

| | | | | |
|---|---|---|---|---|
| 2,854,185 | A * | 9/1958 | Steen | 383/20 |
| 6,010,000 | A * | 1/2000 | Tran | 206/424 |
| 6,345,912 | B1 * | 2/2002 | Ho | 383/20 |
| 6,698,116 | B2 * | 3/2004 | Waldron | 40/124.11 |
| 2002/0024214 | A1 * | 2/2002 | Wagner | 283/71 |
| 2004/0195134 | A1 * | 10/2004 | Li | 206/457 |
| 2005/0204600 | A1 * | 9/2005 | Lauer et al. | 40/594 |
| 2006/0086014 | A1 * | 4/2006 | Plank et al. | 40/124.06 |
| 2006/0151340 | A1 * | 7/2006 | Meister | 206/232 |
| 2006/0196787 | A1 * | 9/2006 | Lewis | 206/232 |
| 2007/0201772 | A1 * | 8/2007 | Schindele | 383/40 |

* cited by examiner

*Primary Examiner* — Gary Hoge

(74) *Attorney, Agent, or Firm* — Harold G. Furlow, Esq.

(57) ABSTRACT

A greeting bag is described that is includes a gift bag and a greeting card. The gift bag and greeting card connect together to form the integrated assembly of the greeting bag that has a purposefully coordinated single decorative style. The gift bag and greeting card have individual decors that define alternative aspects of that particular theme of a decorative style. An attachment mechanism can also be included in the greeting bag that further fixes the greeting card to the gift bag. The attachment mechanism can have a third decor as well as a size and dimensions that can include an image or sentiment. A method is described wherein a greeting bag is selected by selecting a gift bag from a set of one or more gift bags that share a common decorative style. A greeting card is selected from a set of one or more greeting cards that share the same common decorative style with the gift bag. The optional attachment mechanism is selected from a set of one or more attachment mechanisms that share the same common decorative style with the gift bag and greeting card. The gift bags, greeting cards and attachment mechanisms can be selectively mixed and matched from different sets within the decorative style.

20 Claims, 7 Drawing Sheets

APPARATUS AND METHOD FOR A GREETING BAG

CROSS-REFERENCE TO RELATED APPLICATIONS

This application is a continuation application of and claims priority to patent application Ser. No. 12/229,133 filed Aug. 20, 2008, which is a continuation of and claims priority to PCT/US2008/009907 filed Aug. 20, 2008 and which claims priority to provisional application 60/965,674 filed on Aug. 21, 2007 the disclosures of which are incorporated by reference herein and made a part of this application.

BACKGROUND OF THE INVENTION

1. Field of the Invention

The present invention relates to an apparatus and method for a greeting bag and more specifically to an apparatus and method for a greeting bag that comprises a gift bag and a greeting card and a method for selecting a greeting bag.

2. Description of the Related Art

Gift giving has traditionally involved the presenting of an appropriately gift wrapped gift and a card that is enclosed in an envelope to a recipient. The gift is often meticulously wrapped in wrapping paper and accented with ribbons. The card includes a personalized hand written sentiment on the inside and is then enclosed in a labeled envelope that identifies the recipient.

This gift giving process has been pleasantly enhanced by the use of gift bags that provide a different method of presenting the gift from the traditional gift wrapping and enveloped card. The gift is placed in the gift bag and may or may not be separately wrapped, but it is typically placed within and concealed by a loose arrangement of tissue paper in the gift bag. The card, independently selected by the gift giver, is personalized, enclosed in an envelope and remains unchanged from the traditional process. The envelope enclosed card can be positioned within the gill bag or presented separately with the gift in the gift bag to the recipient.

Gift bags have decorations on their outer surfaces in a broad range of patterns, colors and finishes. These decorations can be occasion specific or broadly tailored for a range of celebratory events. In this manner, gift bags have become minor works of art that include fanciful shapes, bold colors and three dimensional accessories that are connected to the outside surface of the bag such as artificial flowers and textured fabrics that can enhance the appeal of the gift bag.

Some gift bags have attached tags or labels that identify the gift giver and recipient. The tags vary in size and material, but are small pieces of paper folded or unfolded that are most frequently decorated identical to the gift bag. The gift tag typically provides the requisite "to" and "from" information, but lacks the physical dimensions for additional expression. In particular, gift tags lack the surface area to express a personalized sentiment that is appropriate for most gift giving situations.

Gift tags can be detachable from the gift bag or permanently attached. When detachable, the gift giver has the concern that the gift tag is going to be separated from the gift bag/gift and the connection between the gift and gift giver lost. Permanently connected gift tags prohibit the recipient from the common practice of reusing the gift bag on another occasion.

Whether a gift bag is new or reused, the gift giver needs to select a separate greeting card and envelope to accompany the gift bag and gift that is appropriate for the occasion. The greeting card is enclosed by the envelope and is commonly positioned separately within the gift bag with the gift when presented to the recipient. The greeting card has a larger size than the gift tag with the room for an appropriate printed greeting and/or hand written personalized sentiment.

A greeting card positioned separately in the gift bag, however, also retains the same risk as the gift tag of becoming separated from the gift prior to the gift giving or disassociated from the gift after the gift giving. Some gift bags provide a device such as an internal or external pocket, for example, that can receive a separately selected greeting card that has compatible dimensions. This enables the greeting card, gift bag and gift to be simultaneously presented, but the concern of disassociation between the greeting card and gift remains. Gift bags are not specifically constructed to receive and retain a purposefully coordinated greeting card in a decorative manner that enhances the gift giving process.

The gift bags and greeting cards heretofore have been separate items that are purchased individually without being purposefully constructed for a physically integrated relationship. Further, gift bags and greeting cards have been decoratively separate items that are purchased individually without being purposefully designed with a shared single decorative theme.

A gift bag and greeting card combination is needed that can physically connect and visually present the gift bag and greeting card together as a purposefully physically integrated and decoratively coordinated assembly that enhances the gift giving process.

Further, a method of selecting gift bags and greeting cards is needed wherein the gift bag and greeting card share a purposefully decoratively coordinated style and physical integration process.

Still further, a method of selecting a set of gift bags from a group of gift bags and a set of greeting cards from a group of greeting cards is needed wherein the group of gift bags and group of greeting cards share a purposefully decoratively coordinated style and physical integration process.

SUMMARY OF THE INVENTION

A greeting bag is described that comprises a gift bag that has a front wall, a back wall and lateral sidewalls. The lower edges of the walls connect to a bottom to define a container. The walls have an upper edge that is a rim that defines an opening of the gift bag. A receptacle is defined by the opening, walls and bottom. A slot is defined in a portion of the front wall. The gift bag has a first décor.

The greeting bag also includes a greeting card that has a first wall and a second wall that are connected by a fold. The first wall includes an outwardly directed face. The second wall of the greeting card is adapted for being received by the slot of the gift bag. The face of the greeting card has a second décor.

A purposefully coordinated single decorative style unifies the first décor of the gift bag and the second décor of the face of the greeting card. The greeting bag can optionally include an attachment mechanism.

The greeting bag has a first position wherein the greeting card is separate from the gift bag and a second position wherein the second wall of the greeting card is at least partially inserted into the slot to removably connect the greeting card to the gift bag. The face of the greeting card in the second position is located over a portion of the sidewall of the gift bag. A purposefully coordinated single decorative style integrates the first décor on the sidewall of the gift bag and the second décor on the outwardly directed face of the greeting card. The optional attachment mechanism is selectively applied to secure the first wall of the greeting card to the sidewall of the gift bag.

The attachment mechanism selectively connects the greeting card using at least one additional slot in the gift bag. The attachment mechanism has a third décor and the third décor integrated with the purposefully coordinated decorative style. The attachment mechanism can be a gift sticker. The attachment mechanism includes a greeting term. The greeting card has a front face and a rear face and each face has an alternative version of the second décor. The gift bag further includes a handle.

A method of selecting a greeting bag is described comprising the steps of selecting a gift bag from a set of gift bags. Each gift bag of the set of gift bags has a first décor that is purposefully coordinated with a decorative style. The gift bag has a wall that defines a slot.

The method includes selecting a greeting card from a set of greeting cards. Each greeting card of the set of greeting cards has a second décor that is purposefully coordinated with the decorative style. The method also includes connecting the greeting card to the gift bag using the slot and integrating the second décor of the greeting card with the first décor of the gift bag. The first décor of the gift bag is purposefully coordinated with the second décor of the greeting card.

The method can further include the step of connecting the greeting card to the gift bag using an attachment mechanism. An attachment mechanism can be selected from a set of attachment mechanisms. Each attachment mechanism has a third décor that is purposefully coordinated with the decorative style. The third décor is purposefully coordinated with the first décor and the second décor. Once the greeting card is connected to the gift bag, it can be separated from the gift bag. The separating of the greeting card from the gift bag includes sliding the greeting card from one or more slots in the gift bag. The separating of the greeting card and gift bag can further include detaching at least a portion of the attachment mechanism from connecting the greeting card and gift bag.

The selecting of the gift bag and greeting card can be done approximately simultaneously. The selecting of the gift bag, greeting card and attachment mechanism can also be done approximately simultaneously. The set of gift bags includes at least one gift bag. The set of greeting cards includes at least one greeting card. The set of attachment mechanisms includes at least one attachment mechanism. A gift bag can be selected from one or more sets of gift bags and a greeting card from one or more sets of greeting cards that have the same decorative style.

This method includes selecting a gift bag from a set of gift bags that can be selectively combined with a greeting card from a set of greeting cards that share the common decorative style and process of physical integration. The set of gift bags and set of greeting cards accommodates the mixing and matching between the sets to define a desired single purposefully integrated and coordinated decorative style of gift bag and greeting card for a given occasion and/or recipient with an enhanced gift giving presentation.

This method includes selecting a set of gift bags from a group of gift bag sets that can be selectively combined with a set of greeting cards from a group of greeting card sets that share a common decoratively coordinated theme and process of physical integration. The groups of gift bags and groups of greeting cards accommodating the mixing and matching between the sets to define a single purposefully integrated and coordinated decorative style of gift bag and greeting card for a given occasion and/or recipient with an enhanced gift giving presentation.

DETAILED DESCRIPTION OF THE INVENTION

Figure 1:
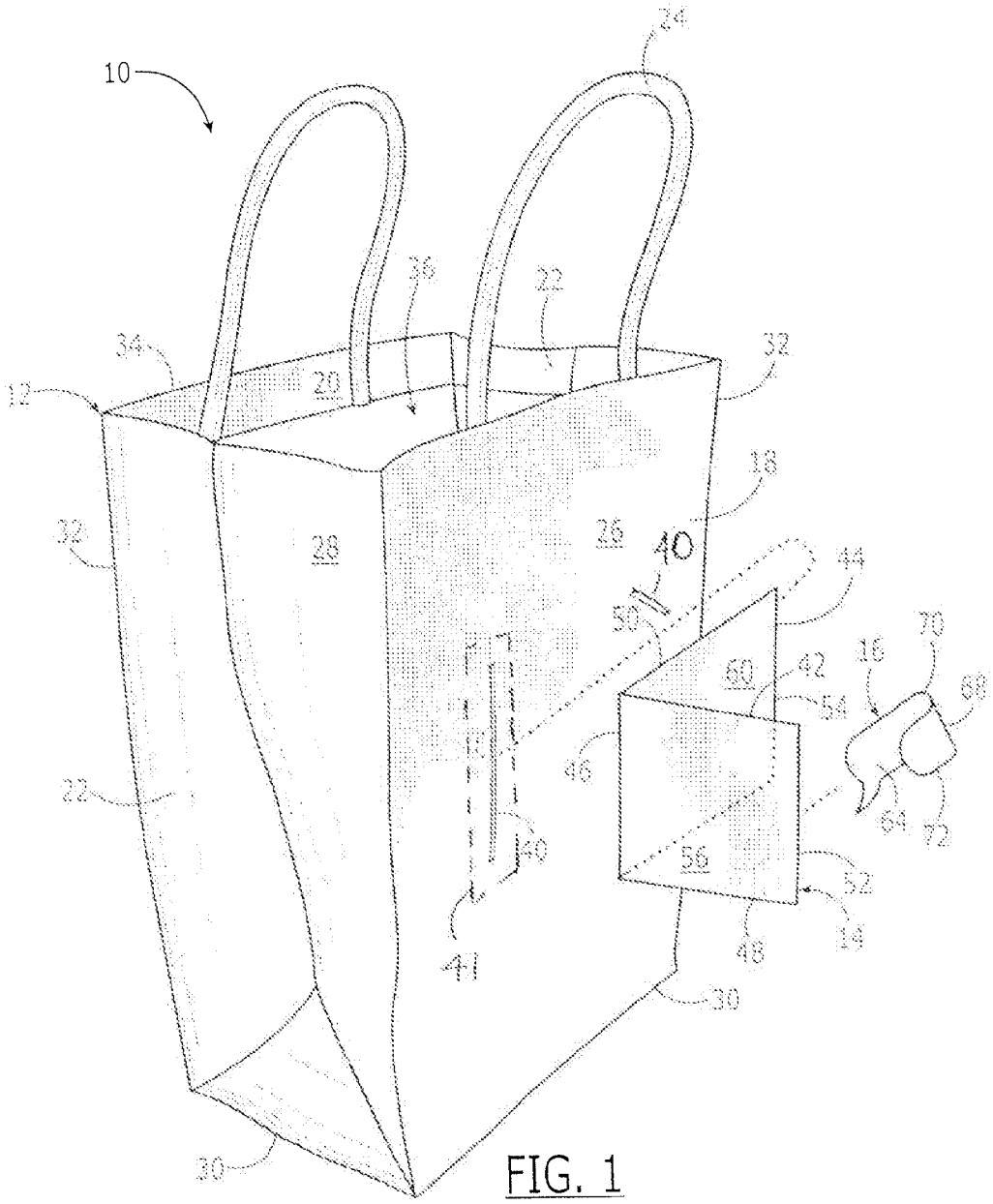
FIG. 1 is a side and front perspective view of a greeting bag that includes a gift bag, a greeting card and an attachment mechanism combination constructed in accordance with the present disclosure.

Referring to the drawings and initially to FIG. 1, a greeting bag 10 includes a gift bag 12, a greeting card 14 and an optional attachment mechanism 16. Gift bag 12, greeting card 14 and attachment mechanism 16 connect together to form the integrated assembly of greeting bag 10 that has a purposefully coordinated single decorative style. Greeting bag 10 is shown in a first position with gift bag 12, greeting card 14 and attachment mechanism or gift sticker 16 separated from each other.

Gift bag 12 is an open-ended container or receptacle for the retention of one or more objects such as a gift, any accompanying decorative gift covering and a greeting card. Gift bag 12 in the preferred embodiment has a front wall, 18, an opposed back wall 20, a pair of opposing lateral sidewalls 22 and a bottom. The bottom edges 30 of gift bag 12 are defined by the intersection of front wall 18, back wall 20, sidewalls 22 with the edges of the bottom. Side edges 32 are defined by the intersection of front wall 18 and back wall 20 with sidewalls 22. Walls 18, 20 and 22 form a continuous wall of bag 12. A continuous edge or rim 34 is formed by the top edges of front wall 18, back wall 20 and sidewalls 22. Rim 34 defines an opening or aperture 36 of bag 12. Gift bag 12 can also include a handle 24.

In this preferred embodiment gift bag 12 walls 18, 20 and 22 and the bottom wall 26 are rectangular. Bottom edge 30 that joins front wall 18 and the bottom wall defines a horizontal axis-X. Side edge 32 that joins front wall 18 and side wall 22 defines a vertical axis-Y. It is understood that gift bag 12 can have one or more walls of any shape to include arcuate as well as other planar forms such as, for example, triangular and square.

Each of walls 18, 20 and 22 has an outer facing surface or face. Front wall 18 has a face 26 and sidewalls 22 have outer faces 28. At least face 26 has a first décor that is a specific mode of decoration that can include various colors and/or images that are in consonance with the decorative style of greeting bag 10. The first décor can use a single shade of color or have multiple colors that advantageously harmonize, complement or clash into an eye catching décor. The first décor can also include images such as animals, plants, geometric shapes and/or seascapes, for example. In one preferred embodiment the first décor of gift bag 12 includes a background that has a first set of one or more colors and vertical stripe pattern that has a similar, but yet distinct second set of one or more colors.

In this preferred embodiment, front wall 18 includes a slot 40 that is aligned with the vertical axis-Y and extends a predetermined length between bottom edge 30 and top edge 34. Slot 40 has a length that is sufficient to receive and retain greeting card 14 in the second position of greeting bag 10. Slot 40 locates greeting card 14 at a predetermined position on face 26 and thus the positioning of slot 40 takes into account factors such as the height and width dimensions of greeting card 14 as well the dimensions of any attachment mechanism 16. In this preferred embodiment slot 40 is centrally positioned between bottom edge 30 and top edge 34 of front wall 18 and side edges 32. Slot 40 can be a straight cut or have an ornamental design that integrates with the decorative style of greeting bag 10. It is understood that the angular alignment of slot 40 relative to the vertical axis-Y can vary depending upon factors such as the decorative style of greeting bag 10 as well as the construction and dimensions of greeting card 14.

Slot 40 can include reinforcing 41 that improves the structural integrity of front wall 18. For example, depending upon the thickness and rigidity of wall 18, the area of wall 18 in proximity to slot 40 can be reinforced with one or more additional layers of material such as paper, tape, glues and/or stitching that enhance the structural integrity of front wall 18. Reinforcing 41 can be on the opposed side of wall 18 and/or on outer face 26.

Handles 24 connect to gift bag 12 and provide a structure for readily grasping and carrying gift bag 12. Handles 24 are preferably arcuate loops that extend above edges 34. Handles 24 can be fabricated of any of a broad range of commonly used materials such as polymers, composites, fabrics, fibers and cellulose. Handles 24 can have any structural configuration such that bag 12 can be readily grasped to include, for example, by holes defined in walls 18 and 20 in proximity to top edges 34.

Gift bag 12 can be fabricated using one or more of a broad range of materials to include polymers, fabrics, composites, cellulose materials, etc. Gift bag 12 can also include coatings that can, for example, add gloss or shine to a given material or textures that enhance the appearance or tactile sensation of bag 12.

Greeting card 14 has a first wall 42 connected to a second wall 44 by a fold 46. Walls 42 and 44 have, a bottom edge 48 and a top edge 50. First wall 42 has an outer edge 52 and second wall 54 has an outer edge 54 that are opposed to fold 46. First wall 42 has an outer facing surface or face 56 and an inner opposed facing surface. Second wall 44 has an inner facing surface or face 60 and an opposed outer facing surface.

Figure 2:
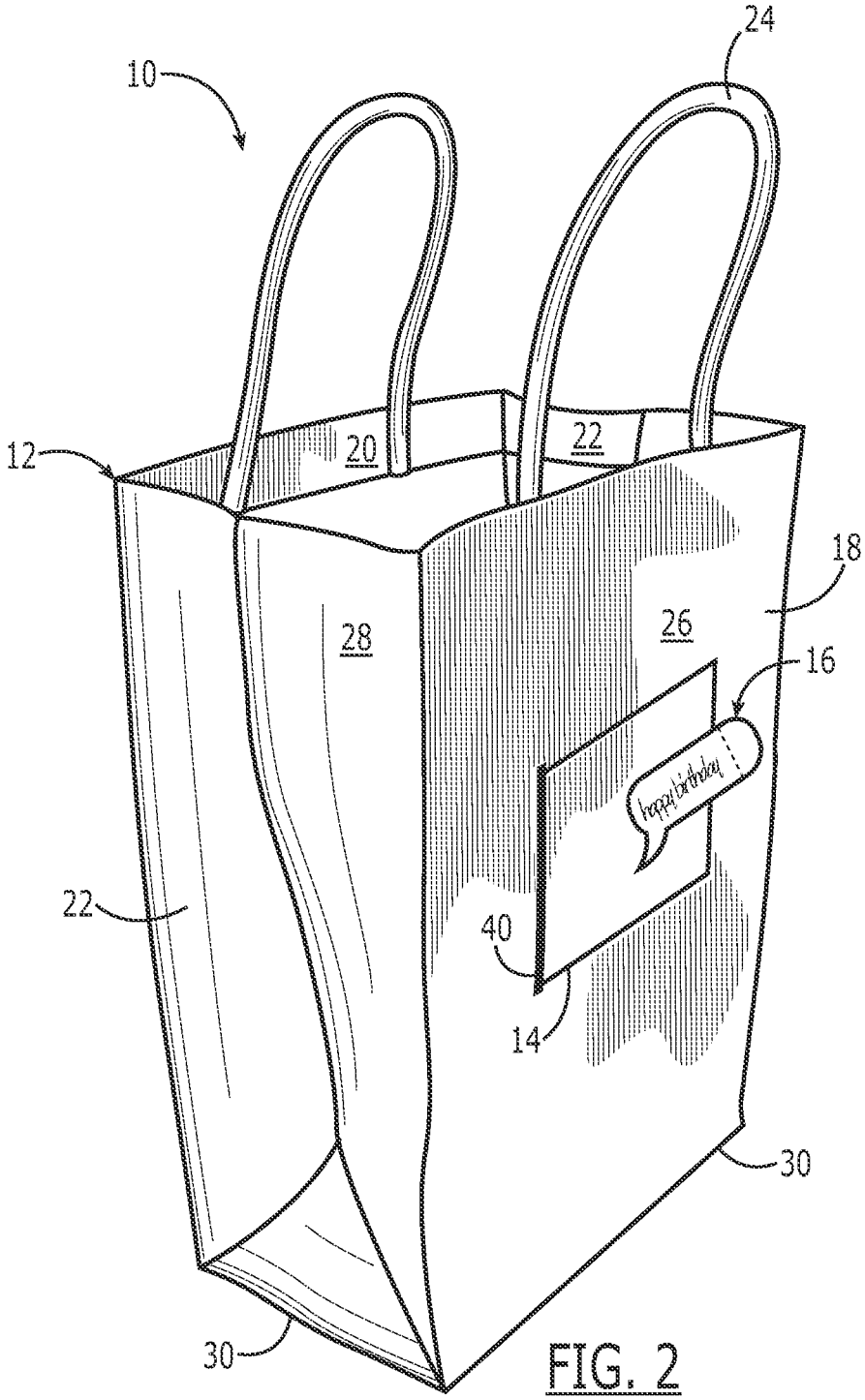
FIG. 2 is a side and front perspective view of the greeting bag of FIG. 1 integrated into a single assembly.

As shown in FIGS. 1 and 2, greeting bag 10 in the second position includes second wall 44 of greeting card 14 inserted into slot 40 up to approximately fold 46. At least the face 56 of first wall 42 has a second décor that has a coordinated decorative relationship with the first décor of gift bag 12 to define the decorative style of greeting bag 10. For example, greeting card 14 has a background set of colors that is the same as the second set of colors for the vertical stripe pattern of gift bag 12 described previously in this one preferred embodiment and greeting card 14 is a foreground that compliments the first décor and a vertical stripe pattern that aesthetically compliments the second set of set of colors.

In one preferred embodiment, greeting card 14 has alternative primary faces on first wall 42 and second wall 44, respectively. Face 56 of first wall 42 and the opposed outer facing surface of face 60 of second wall 44 of greeting card 14 can alternatively be selected as a primary face. Each of these faces is preferably used to provide an alternative variation on the second décor of greeting card 14. As an example, face 56 can have a first variation of a vertical striped pattern and the opposed outer facing surface of face 60 has a second variation of the vertical striped pattern such that either face 56 or the opposed outer facing surface of inner facing surface 60 can become the primary face of greeting card 14 that is positioned over face 26 of gift bag 12 and received by the gift recipient of greeting bag 10.

Greeting card 14 is preferably made of cellulose, but can also be fabricated of polymer, fabric or other materials. Decorative themes are applied to greeting card 14 using standard techniques known in the art of gift bag decoration to include manually, adhesives, embossing, silk screening and printing.

Attachment mechanism 16 provides an additional method to selectively fix greeting card 14 to gift bag 12. Attachment mechanism 16 can include, for example, an additional pair of slots parallel to slot 40 through which wall 18 passes through to remain substantially in view on gift bag 12, one or more angled slots in wall 18 of gift bag 12 that are positioned to receive the corners of first wall 42 formed by outer edge 52 with bottom edge 48 and top edge 50, the direct use of a temporary adhesive on greeting card 14 and/or on the use of an adhesive on a separate component such as a sticker.

Attachment mechanism or gift sticker 16 in this preferred embodiment has a front side 64 that has a third décor that corresponds with and/or compliments the décor of gift bag 12 and greeting card 14. The third décor is integrated with the first and second decors and can be as simple as a sentiment or greeting term 66 or a décor that corresponds with the decorative style. Term 66 has one or more letters, words, images and/or symbols that are directed towards an occasion or a broad celebratory theme. For example, term 66 can range from a single word such as "Celebrate" to phrases such as "I Love You" that can apply to multiple occasions or "Happy Birthday" that is event specific. The third décor of gift sticker 16 can range widely from being purely ornamental to a clear polymer having an encapsulation of term 66 in a comic strip type balloon, for example, that can be positioned to come from the mouth of the face in the second décor of greeting card 14.

Gift sticker 16 has a back side 68 that has an adhesive that readily attaches to the surface of gift bag 12 and greeting card 14. The adhesive provides gift sticker 16 with the ability to make a non-permanent and re-attachable connection between gift bag 12 and greeting card 16. The adhesive can cover all or a portion of back side 68. The adhesive provides a sufficient bond to securely retain first wall 42 against front wall 18 during the presentation of greeting bag 10.

Figure 3:
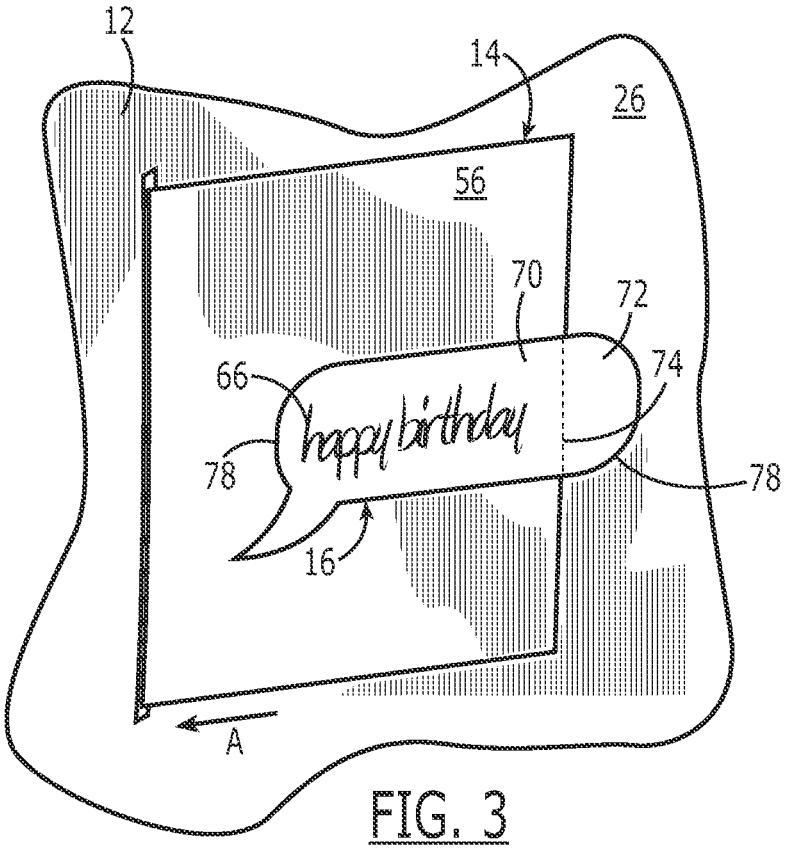
FIG. 3 is a close-up front perspective view of the gift bag, greeting card and attachment mechanism of FIG. 2 with the attachment mechanism securing the greeting card to the gift bag.

As shown in FIGS. 1 and 3, gift sticker 16 has a first portion 70 that connects to greeting card 14, a second portion 72 that connects to gift bag 12 and a release mechanism 74. First portion 70 is preferably of sufficient size to include greeting term 66 and a third décor that is readily viewable by the gift recipient. Release mechanism 74 enables the separation of greeting card 14 from gift bag 12. First portion 70 and second portion 72 each include a terminal end portion 78 of sticker 16.

Release mechanism 74 is preferably located on second portion 72 and can be, for example, a reduced quantity or different adhesive or a tab or an area without adhesive on the opposed back side 68 located in proximity to at least one of the opposed terminal end portions 78 of gift sticker 16. For example, back side 68 can have a reduced portion of adhesive or a different adhesive that is sufficient to retain greeting card 14 first wall 42 in position against gift bag 12, but will separate when greeting card 14 is removed from slot 40 of gift bag 12. Similarly, the tab can include a portion on opposed back side 68 without adhesive that is constructed such that it can be readily grasped and pulled to remove at least one of the portions 70 and/or 72 of gift sticker 16.

Release mechanism 74 can also be a segment of reduced structural integrity that is intended to separate the connection between gift sticker 16 and gift bag 12 and/or greeting card 14. In one preferred embodiment, release mechanism 74 is positioned between first portion 70 and second portion 72 such that upon the removal of greeting card 14 from slot 40 in the second position of greeting bag 10 at least first portion 70 of gift sticker 16 is retained with greeting card 14. In this embodiment, greeting term 66 is preferably positioned on first portion 70 and is then advantageously retained with the greeting card 14 for the recipient. Alternative release mechanism 74 structures can include perforations, a thinned structural wall between front side 64 and back side 68 and/or a structurally narrowed or necked area between opposing edges. In this preferred embodiment of release mechanism 74, first portion 70 and second portion 72 separate at a predetermined level of force approximately in the direction of arrow-A when greeting card 14 is removed from slot 40 of gift bag 12.

As shown in FIGS. 2 and 3, greeting bag 10 in the second position is an integrated assembly of gift bag 12, greeting card 14 and gift sticker 16 that has a purposefully coordinated single decorative style. Greeting card 14 is fully inserted into slot 40 of front wall 18 of gift bag 12 in the second position of greeting bag 10 such that fold 46 is in proximity to slot 40. Face 56 of first wall 42 of greeting card 16 is fully viewable and overlays face 26. Gift bag 12 has a first décor on face 26 of front wall 18 and greeting card 14 has a corresponding second décor on face 56 of first wall 42 that integrate together into a single decorative style. En this preferred embodiment, face 56 has a second décor that does not include words and gift sticker 16 and term 66 can be selectively employed to provide an initial personalized greeting for greeting bag 10.

Slot 40 is positioned on front wall 18 with specific consideration to the dimensions of faces 26 of gift bag 12 and the dimensions of face 56 of first wall 42. The position of slot 40 further includes considerations regarding the appeal of the presentation of decorative style of greeting bag 10 and the enhancement of the integrated arrangement of the second décor of greeting card 14 with the first décor of gift bag 12. In this preferred embodiment of the second position of greeting bag 10, slot 40 centrally positions greeting card 14 on front wall 18 of bag 12.

Figure 4:
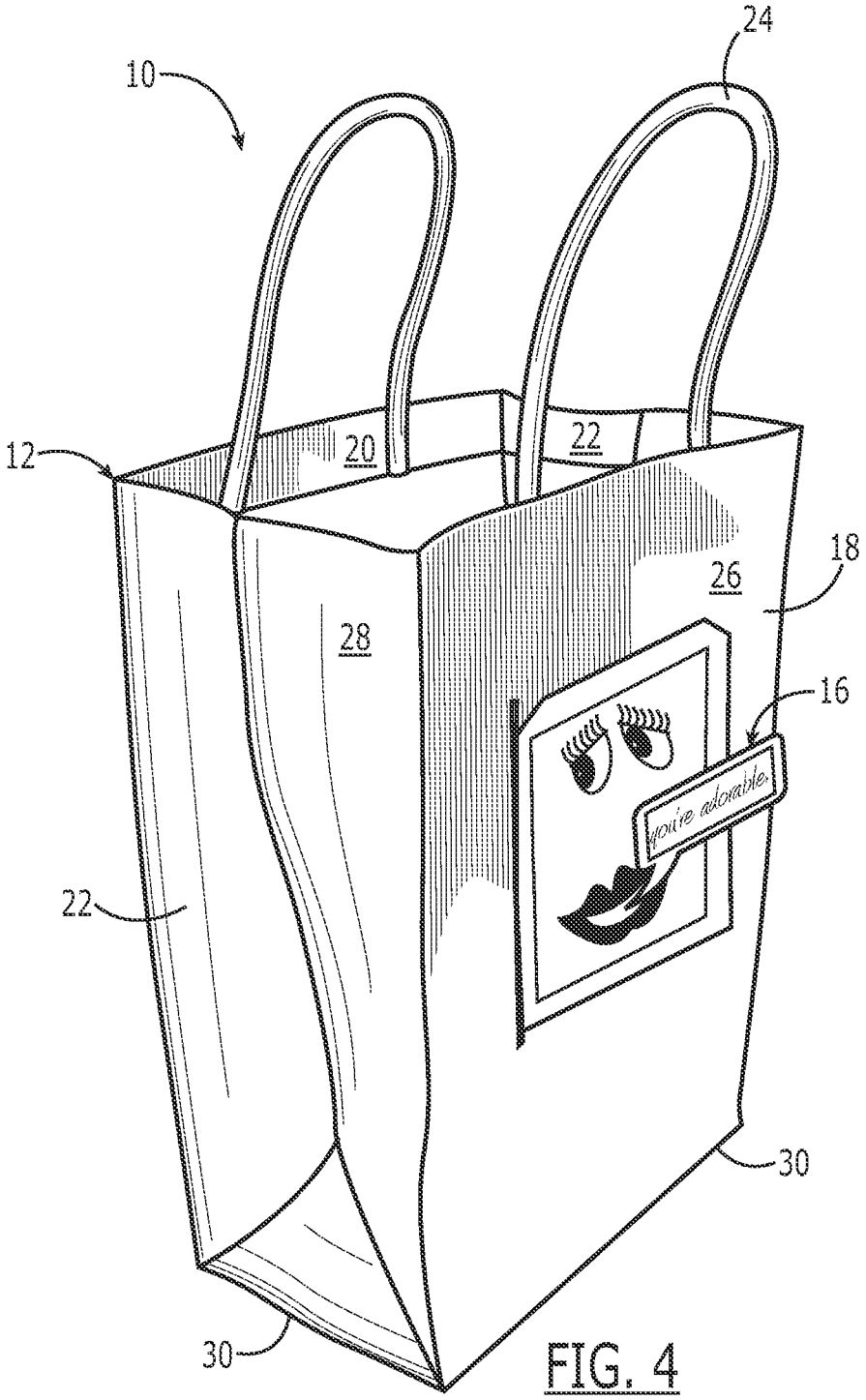
FIG. 4 is one example of a decorative style of the gift bag, greeting card and attachment mechanism of the greeting bag of FIG. 1.

Referring now to FIG. 4, the decorative style of greeting bag 10 is defined herein as a particular, distinctive, characteristic mode or form of construction of a work of art such as depicted and purposefully allocated by the decors of bag 12 and greeting card 14. A theme as defined herein is a unifying or dominant idea or motif that purposefully brings gift bag 12 and greeting card 14 together into a coordinated single decorative style. It is understood that a decorative style can encompass more than one theme.

A given purposeful decorative style of greeting bag 10 can include any overarching theme such as for example nature, humanity/human images/man made objects, designs, holidays and specialized occasions. Individual decors of gift bag 12, greeting card 14 and selectively greeting sticker 16 are coordinated with the overarching theme to depict specific aspects of that particular theme of a decorative style. For example, coordinated decors for a nature theme of a decorative style could include seascapes, plants, landscapes and animals with gift bag 12, greeting card 14 and gift sticker 16 depicting the same or alternative decors of a given theme in a decorative style. As another example the overarching theme could be sports with the individual decors of gift bag 12, greeting card 14 and selectively gift sticker 16 depicting different aspects of the same sport such as a football field, football player and football or a combination of different athletic activities such as skate boarding and surfing.

In one preferred embodiment, as a simplified illustrative example of the decorative style of greeting bag 10, at least face 26 of gift bag 12 has a first set of background colors and a distinct second set of colors that are a pattern of stripes that overlay the first set of background colors. Greeting card 14 has a background set of colors that is the same as the second set of colors of gift bag 12 and a pattern of stripes that are same color as the first set of colors of bag 12. The pattern of stripes of gift bag 12 can have different widths or other discriminating distinctions, for example, such that when greeting card 14 is positioned in slot 40 a distinctive complimenting arrangement is created with face 26 of gift bag 12 and face 56 of greeting card 14. Gift sticker 16 in this preferred embodiment can selectively have a third décor that includes colors, images and/or stripes or other geometric shapes that are coordinated with the decorative style of greeting bag 10. Alternatively, the third décor of gift sticker 16 can include a sentiment in addition to the décor or in lieu of the third décor.

In another preferred embodiment, the integrated arrangement of greeting bag 10 includes gift bag 12 that has a first décor and greeting card 14 with a second décor that can further depicts an image such as, for example, a human face with an expression that is appropriate for a given occasion. The facial expressions on face 56 can include for example, a smile to celebrate an event such as a birthday or graduation or alternatively, a sad face that can be associated with a sorry to hear your sick/get well message. Sticker 16 is affixed onto card 14 and bag 12 preferably across edge 52.

The décor of greeting card 16 is congruent with that of gift bag 12 such that the human cartoon-like face can be partially on greeting card 14 and partially on gift bag 12. Similarly, the first décor of gift bag 12 can include a first cartoon-like face that is concealed behind greeting card 14 in the second position and the second décor of greeting card 14 includes a second cartoon-like face such that when greeting card 14 is removed from slot 40, the first cartoon-like face is revealed in the first décor. In this preferred embodiment, sticker 16 includes a term or sentiment 66 that can be a greeting, an endearing phrase, words of support, etc. Sticker 16 can be positioned across edge 52 and aligned so as to appear that the face of greeting card 14 is speaking term 66. Sticker 16 can alternatively include a third décor that is coordinated with the first décor and second décor.

Figure 5:
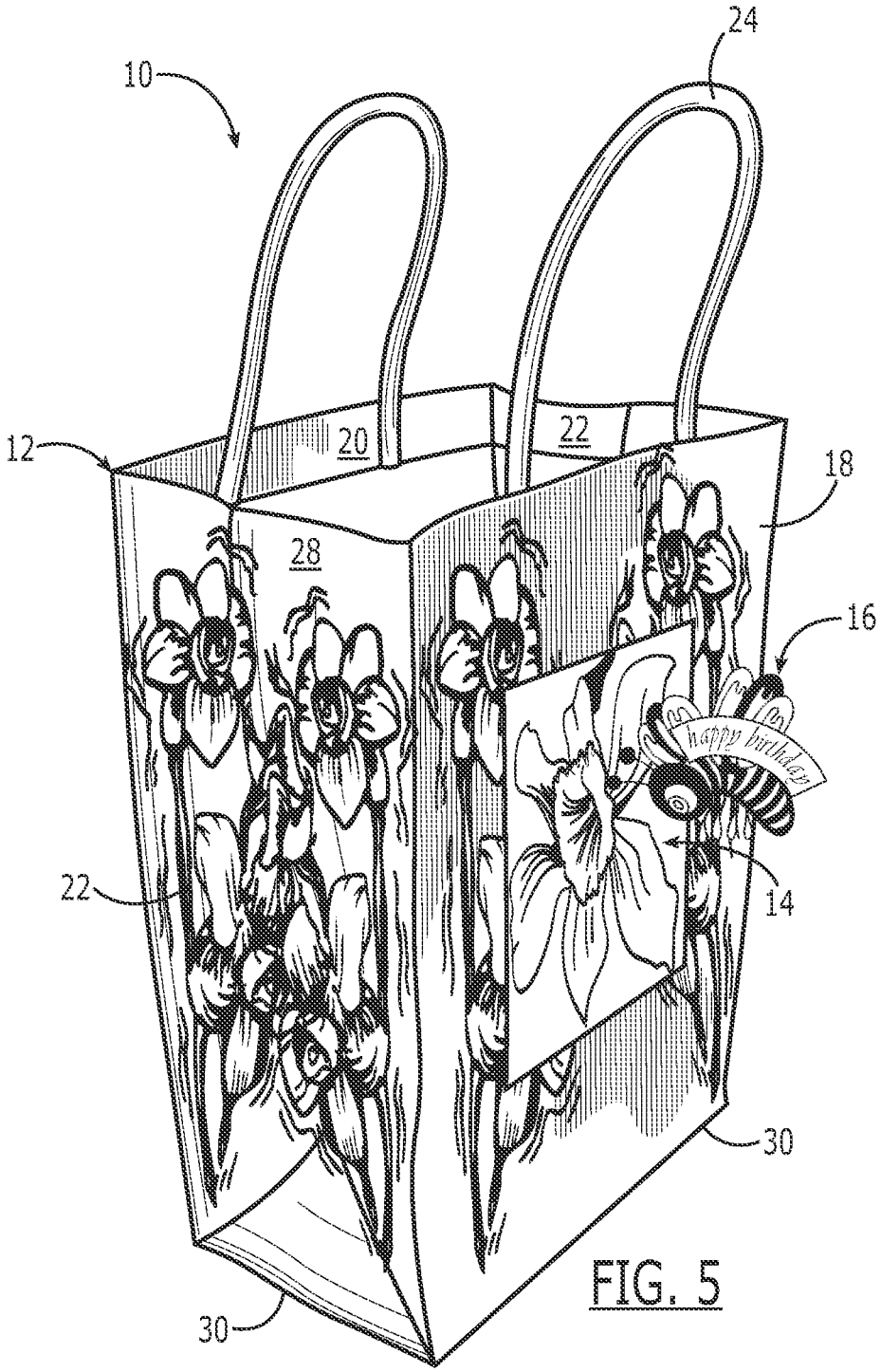
FIG. 5 is a second example of a decorative style of the gift bag, greeting card and attachment mechanism of the greeting bag of FIG. 1.
Figure 6:
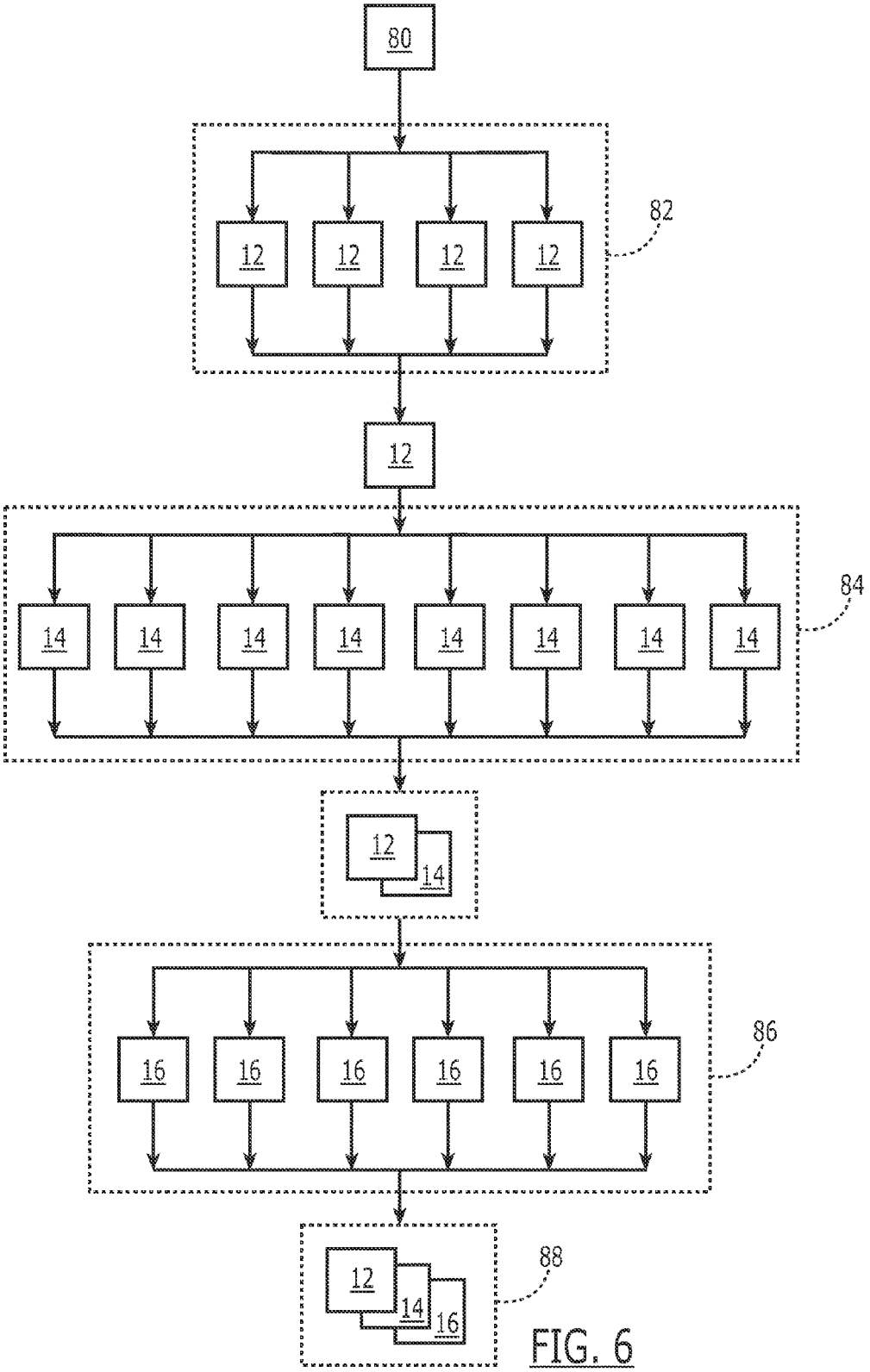
FIG. 6 is a first method for selecting a greeting bag from a set of gift bags, a set of greeting cards and a set of attachment mechanisms.

As shown in FIG. 5, in still another preferred embodiment, the integrated arrangement of greeting bag 10 includes gift bag 12 that has a first décor that is a first depiction of flowers and greeting card 14 that has a second décor that includes, for example, a second depiction of flowers. Gift sticker 16 has a third décor that is congruent with or compliments the first and second decors such as a butterfly, bird or, bee or another depiction of one or more flowers. Gift sticker 16 can selectively further include a greeting term.

Referring now to FIGS. 1-6, in operation the selection of greeting bag 10 includes identifying the occasion and a person 80 that is going to receive the assembled greeting bag 10 and selecting the desired decorative style of greeting bag 10. In this one preferred method, the gift giver views a set of gift bags 82 that share a common decorative style of greeting bag 10. A gift bag is selected from the set of gift bags 82 and is selectively combined with a greeting card 14 from a set of greeting cards 84 that share the common decorative style and mode of physical integration. A set as defined herein, such as the set of attachment mechanisms 86, preferably has at least one item such as a gift sticker 16, but it understood that any set can have zero or more items.

The physical integration of greeting bag 10 includes the angular alignment of slot 40, location of slot 40 on face 26 and the orientation of greeting card 14 with the alignment of slot 40, the selective inclusion of an attachment mechanism 16 and the aesthetic integration of the first décor of gift bag 12 and the second décor of greeting card 14. For example, while greeting cards 14 can be configured to open from any direction, greeting cards 14 generally open from right to left on a vertical fold or from bottom to top on a horizontal fold. Greeting bag 10 advantageously positions slot 40 at a predetermined location on face 26 that positions and integrates the orientation of the fold 46, dimensions and second décor of greeting card 14 with the dimensions and first décor of gift bag 12 in the second position of greeting bag 10. Further, the location of slot 40, dimensions of face 26 and dimensions of greeting card 14 take into account the space required for the positioning of attachment mechanism 16 on face 26 and face 56 of gift bag 12 and greeting card 14, respectively.

The set of gift bags 82 and set of greeting cards 84 accommodate the mixing and matching between the sets to define a desired single purposefully integrated and coordinated decorative style for a given occasion and/or recipient with an enhanced gift giving presentation, but different sets of gift bags 82 and greeting cards 14 can also have differing physical integration processes. For example, attachment mechanism 16 can optionally provide additional security to retain greeting card 14 with gift bag 12 when slot 40 is vertical, but a horizontal slot 40 does not necessarily require attachment mechanism 16 to retain greeting card 14 in position.

Each gift bag 12 in the set of gift bags 82 has an individual décor that reflects one of the themes within the decorative style of the set of greeting bags 10. The viewing of the set of gift bags 12 can be in a store on a rack or shelf as well as on a web site. The gift giver selects one or more of gift bags 12.

A greeting card 14 is selected from the set of greeting cards 84. Each greeting card 14 has an individual décor that reflects one of the themes within the decorative style of that greeting bag 10. For example, greeting card 14 can have an idealized face that has range of facial expressions that can be appropriate from sadness to joy at a significant event. Similarly, the colors and other variables of greeting card 14 are consistent with the one or more decorative themes of the decorative style of gift bag 12. Greeting card 14 in the preferred embodiment is solely a greeting card as defined herein without an envelope that can receive and enclose greeting card 14. It is understood, however, that greeting card 14 can be further accompanied by a separate envelope.

A gift sticker 16 is optionally selected from a set of stickers 86 that provides the desired sentiment for the occasion and person for the gift giving. Each gift sticker has a third décor that reflects one of the themes within the decorative style of greeting bag 10. As described previously, gift stickers can provide decorative accents and/or include a range of differing terms 66 that can be selectively employed to personalize the gift presentation process. Attachment mechanism 16 is an optional part of greeting bag 10.

The selected individual components form a final step 88 of greeting bag 10. Greeting card 10 is prepared and positioned in slot 40. Gift sticker 16 is then selectively applied to selectively fix greeting card 14 and gift bag 12 together to form the integrated assembly of greeting bag 10 that has a purposefully coordinated single decorative style.

The gift bag 12 is preferably selected first because it provides the background décor and greeting card 14 provides a foreground décor which can selectively be an active theme such as a décor for a particular sport, a décor appropriate for a particular hobby or depict a face with a desired expression. Gift sticker 16 provides a coordinated connectivity between gift bag 12 and greeting card 14 that can include a third décor as well as term 66 that is a personalized sentiment within the framework of the given decorative style of greeting bag 10. It is understood that gift bag 12, greeting card 14 and greeting sticker 16 can be selected in any sequence to form greeting bag 10.

Figure 7:
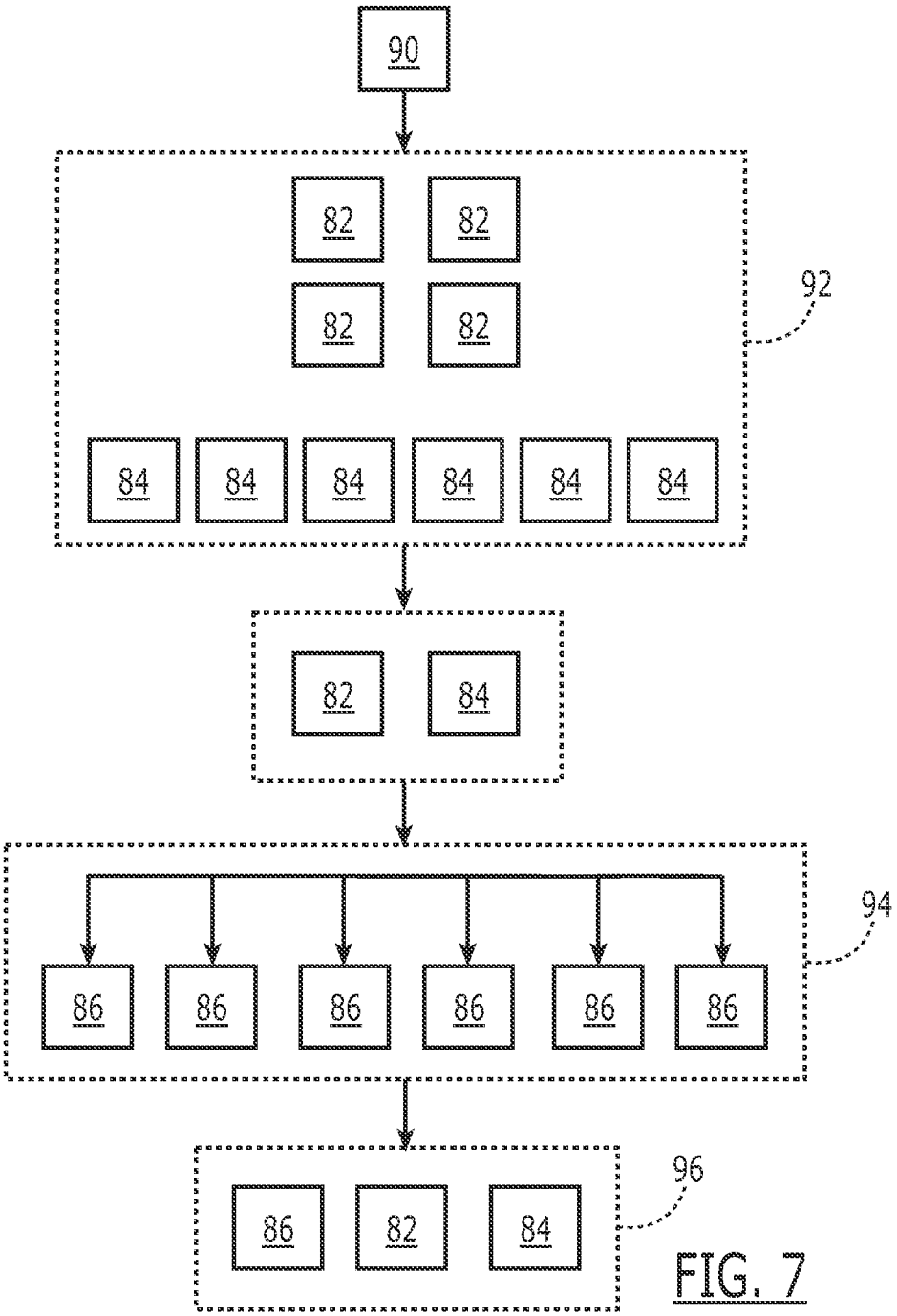
FIG. 7 is a method for selecting a greeting bag from a group of sets of gift bags, a group of sets of greeting cards, and a group of sets of attachment mechanisms.

As shown in FIGS. 1, 2 and 7, a second preferred embodiment of the gift giving process of greeting bag 10 includes an initial person/occasion determination 90. Gift bag 12 and greeting card 14 are selected from a group 92 that includes one or more decorative styles. Group 92 has one or more sets of gift bags 82 and one or more sets of greeting cards 84. This method includes selecting a set of gift bags 82 from a group of gift bag sets 92 that can be selectively combined with a set of greeting cards 84 from a group of greeting card sets 94. The sets of gift bags 82 and sets of greeting cards 84 can have differing themes and decorative styles as well as physical integration of greeting bag 10.

The group of gift bags and greeting cards 92 accommodates the mixing and matching between the sets to define a single purposefully integrated and coordinated decorative theme for a given occasion and/or recipient with an enhanced gift giving presentation. Each set of gift bags 82 and set of greeting cards 84 has their respective decors that are separate and distinct, but are sufficiently close to be encompassed by a single unified decorative style. Thus, in this embodiment, each set of gift bags 82 defines a décor that is preferably unified with a common decorative style for group 92 that can be mixed and matched to maximize the ability of the gift giver to tailor the selection of the individual components of greeting bag 10 for the desired occasion and gift receiver. The sets of gift bags 82, greeting cards 84 and gift stickers 86 can also have one more themes that remain within the decorative style of greeting bag 10. It is preferred that sets gift bags 82 and sets of greeting cards 84 share the same decorative style and physical integration process, but it is understood that group 92 can include one or more differing decorative styles and physical integration processes.

A set of gift stickers 86 is selected from a plurality of sets of gift stickers 94 that have decors that are encompassed by a single unified decorative style. The broad selection of sets of gift stickers 94 enables a gift giver to select from different gift sticker 86 decors and terms 66 for the specific gift receiver and occasion. It is also understood that group 92 and group 94 can be combined into a single integrated selection process wherein any one set of gift stickers 86, set of greeting cards 84 or set of gift bags 82 can be selected first and integrated together with the other sets.

The second embodiment is a group of greeting bags 96 that is made of one or more sets of gift bags 82, greeting cards 84 and selectively gift stickers 86. The group of greeting bags 96 can have one or more decorative styles and potentially include differing physical integration processes such that mixing and match between groups and/or sets can be selectively limited or unlimited.

Referring now to FIGS. 1-7, the components of greeting bag 10 can be selected from a display in a store as well as an internet website based display. Both of these processes preferably begin with the identification of the recipient of greeting bag 10. In a store-based environment this process is performed by the gift giver selecting a greeting bag 10 that can be selected, mixed and matched as individual gift bag 12, greeting card 14 and optional gift sticker 16 components, a prepackaged set of one or more greeting bags 10 with a single decorative theme or kit that include groups of greeting bags 10 with one or more decorative style.

In addition, due to the common practice of reusing common gift bags, greeting bags 10 can be used as a purposeful additional gift by the inclusion of one or more unused greeting cards 14 and optional gift stickers 16 with the primary gift retained by gift bag 12. The individual decors of gift bag 12, greeting card 14 and selective gift sticker 16 are coordinated with the decorative style of greeting bag 10. Thus, a gift giver could provide a greeting bag 10 that subtlety provides a gift bag 12 with one or more additional unused greeting cards 14 and optional gift stickers 16 that can be selectively extended to additional gift giving.

In a computer web based format queries can be made to the gift giver about the gift receiver to identify, for example, the gift receiver's gender, age, whether the relationship is that of a friend, romantic or relative and the occasion for the use of the greeting bag 10. Responses to the above queries direct the gift giver to an appropriate set or group of greeting bags 10 with one or more decorative styles. Alternatively, a gift giver can browse through the range of decorative styles of greeting bag 10 groups and sets. Once the gift giver has selected the desired gift bag 12, greeting card 14 and gift sticker 16 combination, they purchase the desired greeting bag 10 on line and it can be shipped for prompt delivery.

Computer based shopping also allows an increased flexibility wherein a gift giver can have their own personalized greeting printed on gift bag 12, greeting card 14 or as term 66 gift sticker 16. The personalized greeting bag 10 is purchased and then forwarded to the gift giver using known means such as for example, a delivery service. Similarly, gift stickers 16 can be blank and formatted as sheets like address labels and printed using home or commercial computers and printers.

In the preceding specification, the present disclosure has been described with reference to specific exemplary embodiments thereof. It will be evident, however, that various modifications, combinations and changes may be made thereto without departing from the broader spirit and scope of the invention as set forth in the claims that follow. In addition, though the present invention is described in terms of a series of embodiments, each embodiment of the present invention can combine one or more novel features of the other embodiments. The specification and drawings are accordingly to be regarded in an illustrative manner rather than a restrictive sense.

The invention claimed is:

1. A greeting bag that comprises:

a gift bag that a front wall, a back wall and opposed lateral side walls, a bottom connects to a lower edge of the walls to define a container, the walls have an upper edge that is a rim and the upper edge of each of the walls defines an opening of the gift bag, the opening, the walls and bottom define a receptacle, a pair of slots consisting of a first slot and a second slot defined in the front wall;

a greeting card that has a first wall and a second wall connected by a fold, the first wall includes an outwardly directed face, at least one of the walls of the greeting card dimensioned to be connected to the gift bag by the first slot and the second slot, the first slot has a length dimensioned to receive the second wall of the greeting card up to approximately the fold and the first slot dimensioned to retain the second wall of the greeting card, the first slot and second slot position the greeting card at a predetermined position on the gift bag.

2. The greeting bag of claim 1, wherein the first slot and the second slot take into account the height and width of the greeting card to connect the greeting card to the gift bag.

3. The greeting bag of claim 2, wherein the gift sticker provides an additional attachment mechanism for connecting the greeting card and gift bag.

4. The greeting bag of claim 1, wherein the greeting bag further includes a gift sticker.

5. The greeting bag of claim 4, wherein the greeting bag integrates a first décor of the gift bag, a second décor of the greeting card and a third décor of the sticker.

6. The greeting bag of claim 1, wherein the first slot has a length sufficient to retain the greeting card at a predetermined position on the front wall.

7. The greeting bag of claim 1, wherein the greeting card has two alternative faces, the gift bag has a first decor and the greeting card has a second decor, and each face of the greeting card has an alternative version of the second décor.

8. The greeting bag of claim 1, wherein the greeting card is removably connected to the first slot of the gift bag.

9. The greeting bag of claim 1, wherein the first slot and second slot centrally position the greeting card on the front wall of the gift bag.

10. The greeting bag of claim 1, wherein the first slot includes an ornamental design.

11. The greeting bag of claim 1, wherein the slot is reinforced.

12. The greeting bag of claim 1, wherein the greeting card positioned in the first slot integrates a first décor of the gift bag and a second décor of the greeting card.

13. A method of selecting a greeting bag comprising the steps of:

selecting a gift bag from a set of at least one gift bag, each gift bag of the set of gift bags includes sidewalls and a bottom wall, a pair of slots defined in at least one of the sidewalls, the pair of slots consisting of a first slot and a second slot;

selecting a greeting card from a set of at least one greeting cards, each greeting card of the set of greeting cards has walls with defined dimensions and a fold;

integrating the greeting card with the gift bag by positioning one of the walls of the greeting card into the first slot of the gift bag up to approximately the fold, the first slot retaining the greeting card in position on the sidewall of the gift bag, the position of the first slot and the second slot on the sidewall taking into consideration the dimensions of the wall of the greeting card, the first slot for the greeting card integrating a second décor of a second wall of the greeting card with a first décor of the gift bag.

14. The method of selecting a greeting bag of claim 13, wherein the gift bag has a first décor and the greeting card has a second décor and the connecting of the greeting card to the gift bag integrates the first décor and second décor.

15. A method of selecting a greeting bag comprising the steps of:

selecting a gift bag from a set of gift bags, each gift bag of the set of gift bags has a first décor, the gift bag includes a sidewall defining two slots, the two slots consisting of a first slot and a second slot;

selecting a greeting card from a set of greeting cards, each greeting card of the set of greeting cards has walls with defined dimensions and a fold, the greeting card has a second décor;

integrating the greeting card with the gift bag by positioning one of the walls of the greeting card into the first slot, the first slot receiving the wall up to approximately the fold of the greeting card, the first slot dimensioned and the greeting card dimensioned for the first slot retaining the greeting card in position on the gift bag, the position of the first slot and the second slot on the sidewall taking into consideration the dimensions of the wall of the greeting card, the second slot fixing the position of the greeting card in the first slot of the gift bag, the first slot for the greeting card integrating a second décor of a second wall of the greeting card with a first décor of the gift bag.

16. The method of selecting a greeting bag of claim 15 further including a step of additionally fixing the first wall of the greeting card to the front wall of the gift bag using a gift sticker.

17. The method of selecting a greeting bag of claim 15, wherein the positioning of the two slots on the sidewall includes taking into consideration the dimensions of the sidewall of the gift bag and the dimensions of the walls of the greeting card.

18. The method of selecting a greeting bag of claim 15, wherein the first slot and the second slot for the greeting card integrate the second décor the greeting card with the first décor of the gift bag.

19. The method of selecting a greeting bag of claim 15, wherein a first wall of the greeting card is secured against the sidewall of the gift bag.

20. The method of selecting a greeting bag of claim 15 that further includes reinforcing around the first slot.

* * * * *